US006540889B2

(12) United States Patent
Ko

(10) Patent No.: US 6,540,889 B2
(45) Date of Patent: Apr. 1, 2003

(54) CONDUCTING ROLLER ASSEMBLY FOR AN ELECTROPLATING APPARATUS

(76) Inventor: Jason Ko, No. 67-1, Tung-Yuan Rd., Chungli Industrial Park, Chungli City, Taoyuan Hsien (TW)

( * ) Notice: Subject to any disclaimer, the term of this patent is extended or adjusted under 35 U.S.C. 154(b) by 91 days.

(21) Appl. No.: 09/906,970

(22) Filed: Jul. 17, 2001

(65) Prior Publication Data

US 2002/0179437 A1 Dec. 5, 2002

(51) Int. Cl.[7] ..... C25B 9/00
(52) U.S. Cl. ..... 204/279
(58) Field of Search ..... 204/279

(56) References Cited

U.S. PATENT DOCUMENTS 5,939,677 A * 8/1999 Ko ..... 204/279
6,024,849 A * 2/2000 Ko ..... 204/279
6,309,517 B1 * 10/2001 Condra et al. ..... 204/279

* cited by examiner

*Primary Examiner*—Bruce F. Bell
(74) *Attorney, Agent, or Firm*—Hoffmann & Baron, LLP

(57) ABSTRACT

A conducting roller assembly for an electroplating apparatus includes two conducting rollers arranged one above another so as to clamp and move a plate-shaped workpiece therebetween. The rollers are disposed intimately over one of two conducting members, and under the other one of the members. Each of the members is connected to two opposite sides of the respective one of the rollers by means of two horizontal rows of equidistant conducting posts. Each of the posts has one end that is fixed to and that is in electrical connection with a respective one of the members, and another end that is biased to contact the respective one of the rollers so as to establish an electrical connection between the respective one of the members and the respective one of the rollers.

6 Claims, 5 Drawing Sheets

CONDUCTING ROLLER ASSEMBLY FOR AN ELECTROPLATING APPARATUS

BACKGROUND OF THE INVENTION

1. Field of the Invention

This invention relates to a conducting roller assembly for an electroplating apparatus, which processes a workpiece that is shaped as a horizontal plate, more particularly to a conducting roller assembly, which includes two rows of equidistant conducting posts that are in electrical connection with two opposite sides of a conducting roller.

2. Description of the Related Art

During an electroplating operation, a cathode current is generally transmitted from a power supply to a workpiece via two conducting rollers, which are arranged one above another so as to clamp and move the workpiece therebetween. Referring to FIG. 1, a conventional conducting roller 7 is shown to include a rotatable conductive roller body 71 that presses against a side surface of a workpiece 8 (see FIG. 2), such as a horizontal circuit board, and a stationary conducting rod 72 that is inserted into a chamber 711 in a left end portion of the roller body 71. The chamber 711 has two ends 712, 713, which are provided with a pair of bearing members 714, on which the conducting rod 72 is journalled. The roller body 71 is rotated by means of a gear unit 715. An annular seal 73 is sleeved on the conducting rod 72 so as to seal the chamber 711. A conductive liquid 74 is filled in the chamber 711 between the roller body 71 and the conducting rod 72. As such, electric current can be transmitted from the conducting rod 72 to the roller body 71 via the conductive liquid 74. The disadvantages of the conducting roller 7 are as follows:

(1) Referring to FIG. 2, a resistance loss is incurred by the conducting roller 7, and increases gradually from the left end 721 to the right end 716 in view of the condition that only a single cathode current input is provided at the left end 721 of the roller body 71. For example, assuming that the voltage is 2 volts, according to Ohm's law I (current)=V (voltage)/R(resistance),
when R1 is 0.1 (ohm), current is 20 amperes;
when R2 is 0.15, current is about 13.3 amperes;
when R3 is 0.2, current is 10 amperes;
when R4 is 0.25, current is 8 amperes;
when R5 is 0.3, current is about 6.7 amperes;
when R6 is 0.35, current is about 5.7 amperes;
when R7 is 0.4, current is 5 amperes; and
when R8 is 0.45, current is about 4.4 amperes.
As such, the current difference between the left and right ends 721, 716 of the conducting roller 7 is relatively large, thereby resulting in an uneven thickness of metal coating on the circuit board 8. Furthermore, in order to reduce both the resistance loss and the current difference between the ends 721, 716 of the conducting roller 7 so as to maintain the thickness difference of the metal coating within an acceptable range, the length of the conducting roller 7 is limited such that the conducting roller 7 is not suitable for processing a comparatively wide workpiece.

(2) The conductive liquid 74 is normally made of mercury, which is highly poisonous, thereby resulting in serious environmental protection problems caused during filling and disposal thereof.

SUMMARY OF THE INVENTION

An object of this invention is to provide a conducting roller assembly for an electroplating apparatus, which includes rows of equidistant conducting posts that will not result in any environmental protection problem and that can transmit a cathode current evenly to a plate-shaped workpiece, thereby forming an even thickness of metal coating on the workpiece.

According to this invention, a conducting roller assembly for an electroplating apparatus includes two conducting rollers arranged one above another so as to clamp and move a plate-shaped workpiece therebetween. The rollers are disposed intimately over one of two conducting members, and under the other one of the members. Each of the members is connected to two opposite sides of the respective one of the rollers by means of two horizontal rows of equidistant conducting posts. Each of the posts has one end that is fixed to and that is in electrical connection with a respective one of the members, and another end that is biased to contact the respective one of the rollers so as to establish an electrical connection between the respective one of the members and the respective one of the rollers. As such, electric current can be transmitted evenly to the rollers via the posts.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
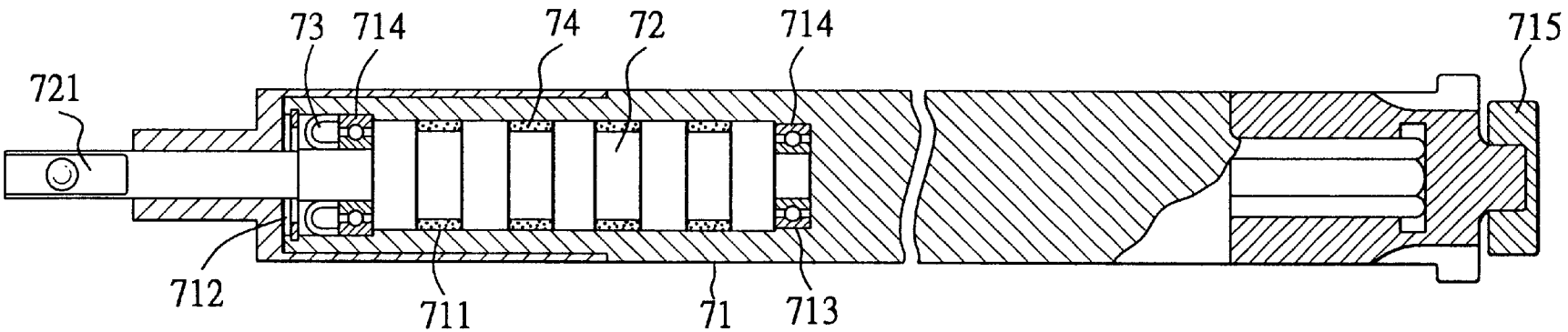
FIG. 1 PRIOR ART
FIG. 1 is a sectional view of a conventional conducting roller for an electroplating apparatus.
Figure 2:
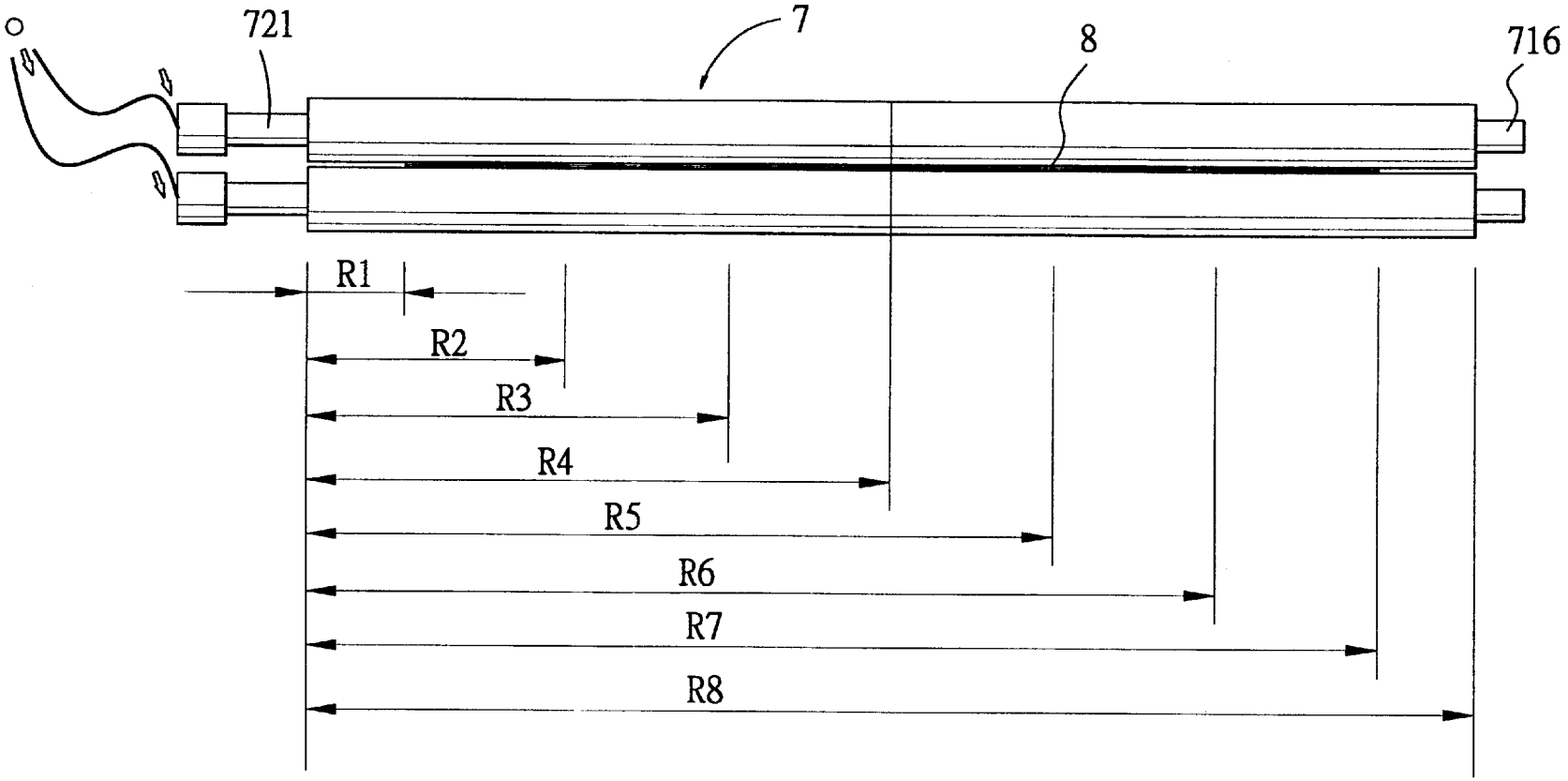
FIG. 2 PRIOR ART
FIG. 2 is a schematic view, illustrating how a horizontal circuit board is disposed between two conducting rollers, each of which has a structure that is shown in FIG. 1.
Figure 3:
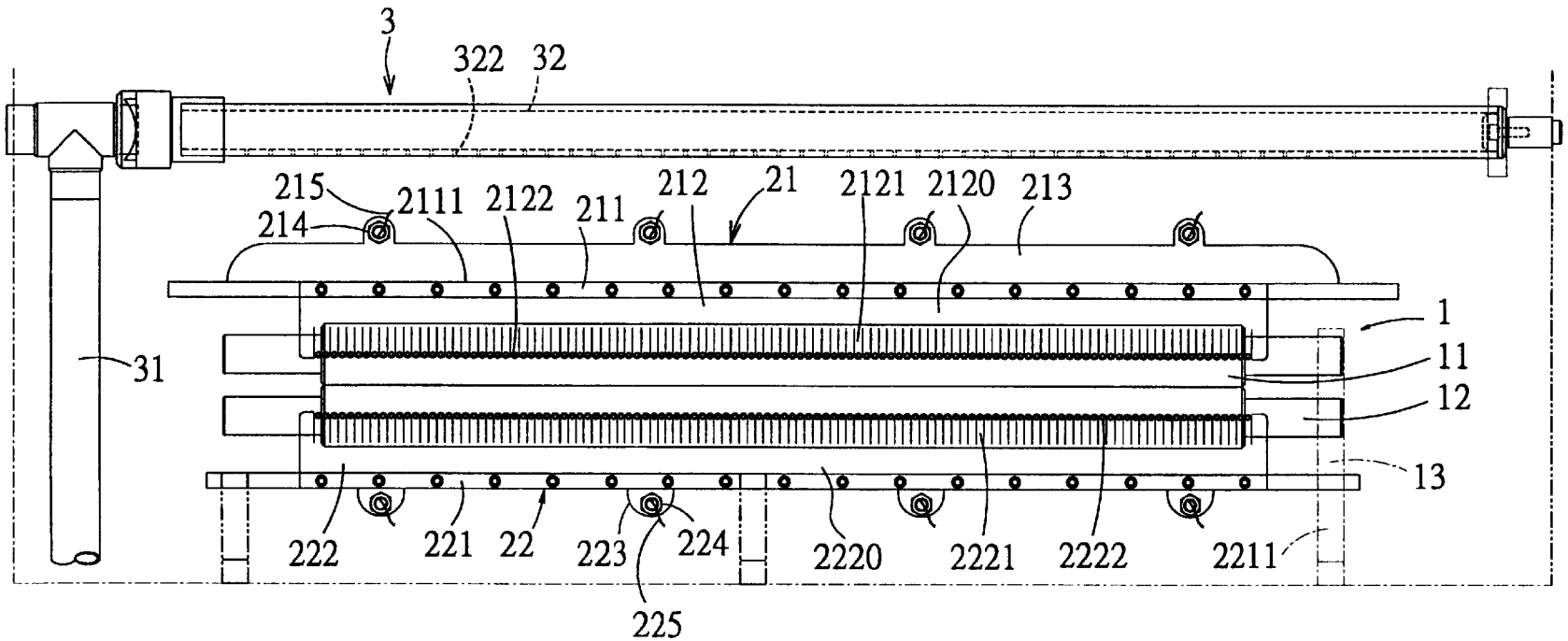
FIG. 3 is a schematic front view of the preferred embodiment of a conducting roller assembly for an electroplating apparatus according to this invention.
Figure 4:
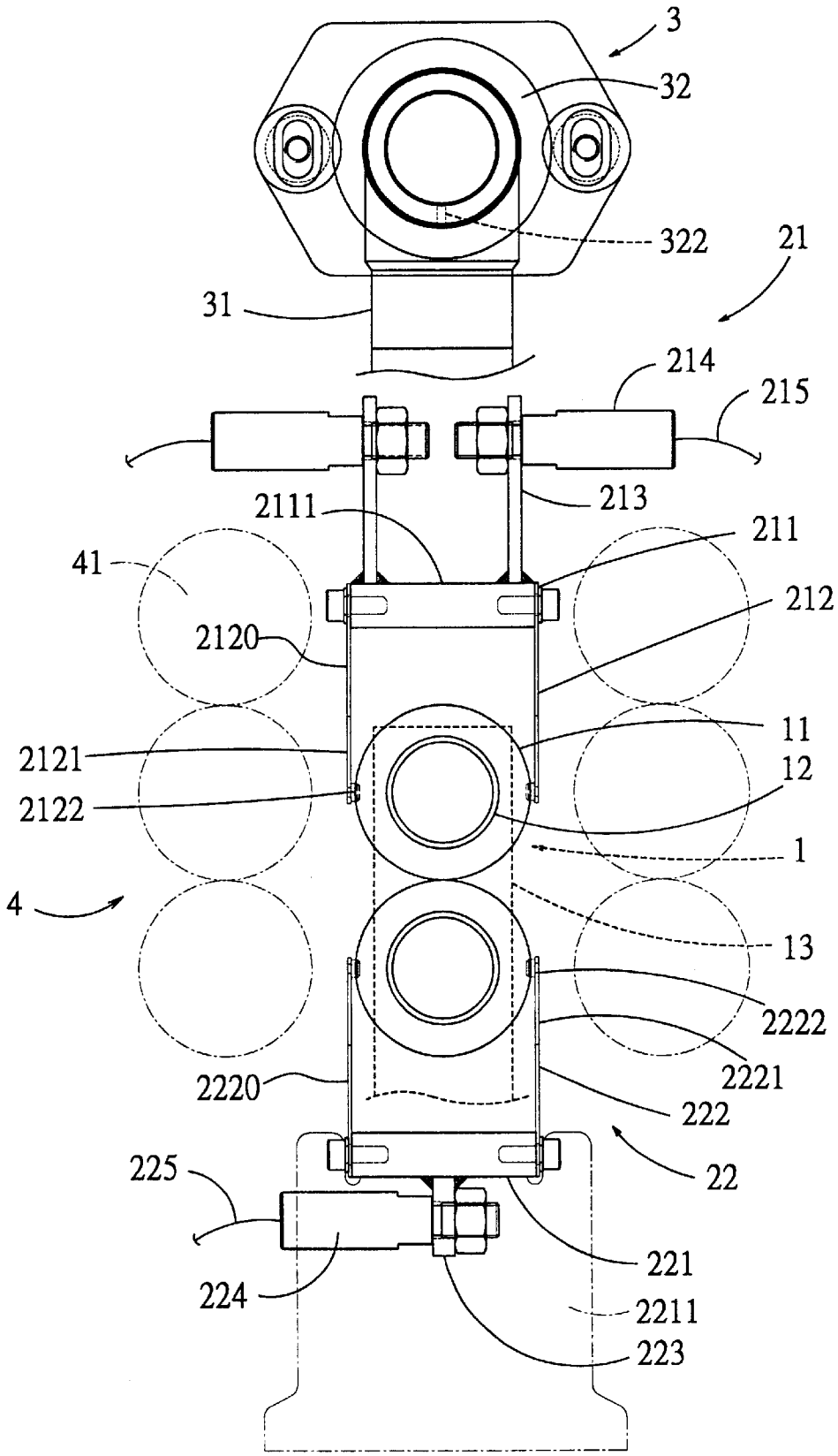
FIG. 4 is a schematic side view of the preferred embodiment.

Referring to FIGS. 3 and 4, the preferred embodiment of a conducting roller assembly for an electroplating apparatus according to this invention is shown to include a pair of conducting rollers 1, a pair of upper and lower conducting units 21, 22, a washing tube device 3, and a water-blocking roller unit 4.

The conducting rollers 1 are arranged one above another so as to clamp and move a workpiece 5 therebetween. Each of the rollers 1 has a conducting section 11 and two diameter-reduced ends 12, which are journalled on a supporting unit that includes two supporting frames 13 of a machine bed (not shown).

The upper conducting unit 21 includes a conducting member 211, a conducting comb-shaped element 212, two horizontal rows of equidistant vertical conducting plates 213, a plurality of terminal pins 214, and a plurality of electric wires 215. The conducting member 211 is disposed intimately over the rollers 1, and is shaped as an elongated horizontal rectangular plate which is longer than the rollers 1 and which has a width that is approximate to the diameter of the conducting section 11 of the upper roller 1. The conducting comb-shaped elements 212 are fixed respectively to two opposite sides of the member 211. Each of the comb-shaped elements 212 has a post-connecting body 2120 that is fixed to and that is in electrical connection with the member 211, and a horizontal row of equidistant conducting posts 2121 that extend integrally and downwardly from the body 2120. Each of the posts 212 has a lower pressing end with an inwardly extending integral projection 2122 that is biased to press against the upper roller 1 for electrical connection therewith. The friction between the upper roller 1 and the projections 2122 is relatively small so that the upper roller 1 can rotate smoothly relative to the posts 212. The rows of the conducting plates 213 are fixed on and are in electrical connection with the opposite sides of a top surface 2111 of the member 211. The terminal pins 214 are fixed to and are in electrical connection with the plates 213, and are connected electrically to a negative side of a power supply (not shown) by means of the electric wires 215, respectively.

The lower conducting unit 22 includes a conducting member 221, a conducting comb-shaped element 222, a horizontal row of equidistant vertical conducting plates 223, a plurality of terminal pins 224, and a plurality of electric wires 225. The conducting member 221 is disposed intimately under the rollers 1, and is shaped as an elongated horizontal rectangular plate which is longer than the rollers 1 and which has a width that is approximate to the diameter of the conducting section 11 of the lower roller 1. The conducting comb-shaped elements 222 are fixed respectively to two opposite sides of the member 221. Each of the comb-shaped elements 222 has a post-connecting body 2220 that is fixed to and that is in electrical connection with the member 221, and a horizontal row of equidistant posts 2221 that extend integrally and upwardly from the post-connecting body 2220. Each of the posts 222 has an upper pressing end with an inwardly extending integral projection 2222 that is biased to press against the lower roller 1 for electrical connection therewith. The conducting plates 223 are fixed on and are in electrical connection with a bottom surface of the member 221. The terminal pins 224 are fixed to and are in electrical connection with the plates 223, and are connected electrically to the power supply (not shown) by means of the electric wires 225, respectively. The member 221 is fixed on a mounting frame 2211 of the machine bed (not shown). Likewise, the member 211 of the upper conducting unit 21 is fixed on the machine bed.

The washing tube device 3 includes a water-supplying conduit unit 31, and a water-spraying tube 32 that is in fluid communication with the conduit unit 31 and that is disposed over the rollers 1 and the upper and lower conducting units 21, 22. The tube 3 is formed with a plurality of closely spaced-apart spraying holes 322 for spraying water downwardly onto the rollers 1.

The water-blocking roller unit 4 includes two vertical rows of rollers 41 that are disposed on two sides of the rollers 1 in a known manner for preventing leaking of water.

Figure 5:
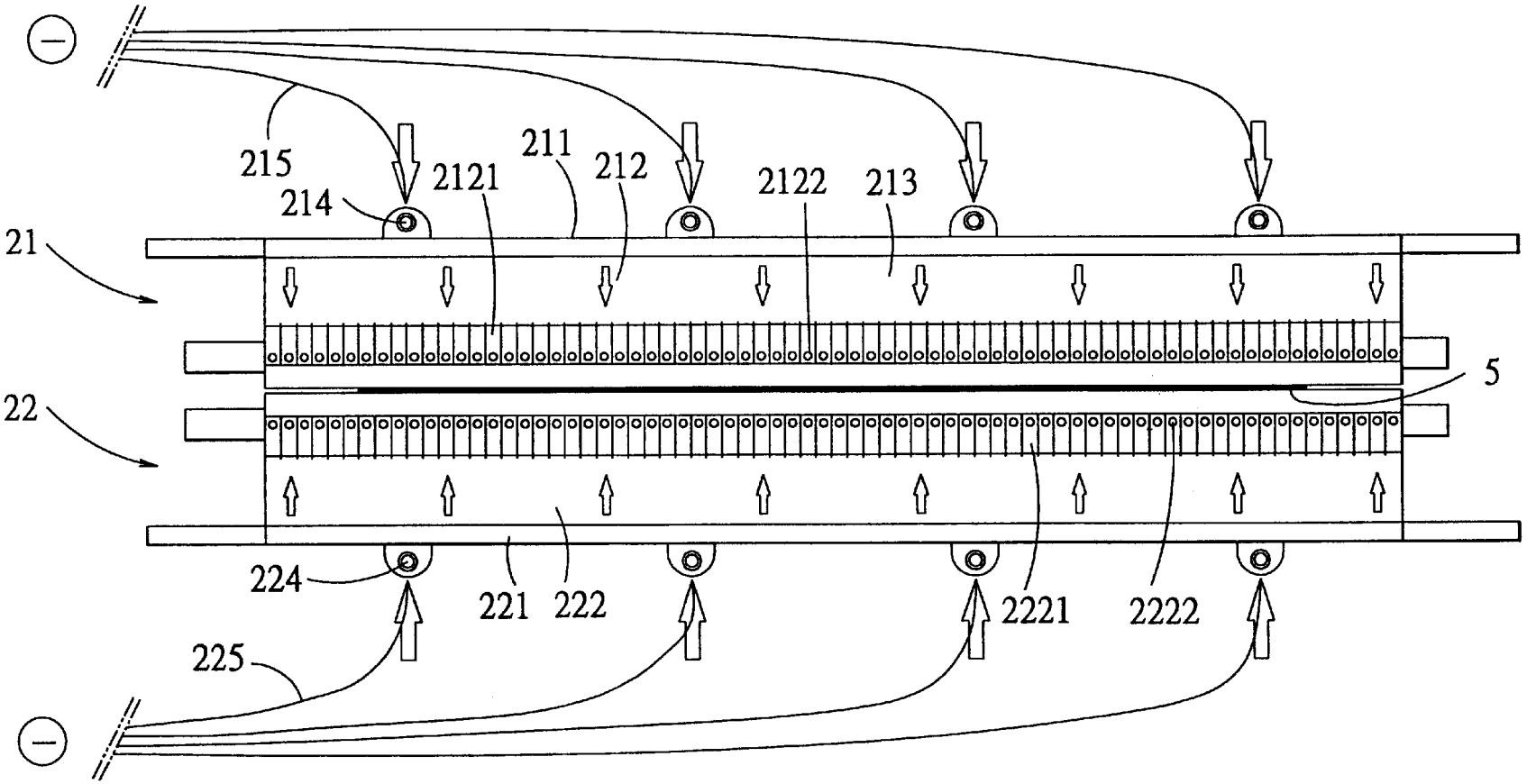
FIG. 5 is a schematic view of the preferred embodiment, illustrating flow paths of electric current from a power supply to a plate-shaped workpiece.

The conducting roller assembly of this invention has the following advantages:

(1) Because the cathode current is transmitted to the rollers 1 via the equidistant posts 212, 222, as shown in FIG. 5, the conducting sections 11 of the conducting rollers 1 have uniform electric current at all positions, thereby enabling formation of an even thickness of metal coating on the workpiece 5. Accordingly, the lengths of the conducting rollers 1 can be increased significantly, thereby increasing the applicable range of the conducting roller assembly of this invention.

(2) The lengths of the flow paths of the electric current between each of the conducting members 211, 221 and the corresponding conducting roller 1 are the same, and are approximate to the heights of the comb-shaped elements 212, 222, which are relatively small so as to minimize the resistance loss along the flow paths, thereby reducing the expenses incurred during electroplating operation.

(3) The projections 2122, 2222 of the posts 212, 222 of each of the conducting units 2 press against two opposite sides of the corresponding conducting roller 1, thereby maintaining even distribution of electric current on the latter.

With this invention thus explained, it is apparent that numerous modifications and variations can be made without departing from the scope and spirit of this invention. It is therefore intended that this invention be limited only as indicated in the appended claims.

I claim:

1. A conducting roller assembly for an electroplating apparatus, said conducting roller assembly comprising:

a supporting unit;

two aligned conducting rollers, each of which has two ends that are journalled on said supporting unit, said rollers being arranged one above another so as to be adapted to clamp a plate-shaped workpiece to be electroplated such that the workpiece moves between and is in electrical connection with said rollers; and two conducting units, each of which includes an elongated conducting member and two horizontal rows of equidistant conducting posts, which are fixed to and which are in electrical connection with said member, said two horizontal rows of said posts being disposed on two opposite sides of a respective one of said rollers, said rollers being located under one of said members and over the other one of said members, said members being fixed relative to said supporting unit and being disposed respectively adjacent to said rollers, each of said members being adapted to be connected electrically to a negative side of a power supply, each of said posts having a pressing end that is biased to contact a respective one of said rollers so as to establish an electrical connection between the respective one of said members and the respective one of said rollers;

whereby, electric current can flow from the power supply to the workpiece via said members, said posts and said rollers.

2. The conducting roller assembly as claimed in claim 1, wherein each of said rollers has a conducting section which has a diameter that is larger than those of the ends thereof, each of said members being shaped as a horizontal rectangular plate, which is longer than the respective one of said rollers and which has a width that is approximate to the diameter of said conducting section of the respective one of said rollers, said posts being fixed to and being in electrical connection with two opposite sides of the respective one of said members, said posts being made of a resilient conducting material so as to bias said pressing ends of said posts of each of said conducting units to press against two opposite sides of the respective one of said rollers.

3. The conducting roller assembly as claimed in claim 1, wherein said pressing end of each of said posts is formed integrally with an inwardly extending projection that contacts the respective one of said rollers, thereby permitting smooth rotation of the respective one of said rollers relative thereto.

4. The conducting roller assembly as claimed in claim 1, wherein each of said conducting units further includes a horizontal row of equidistant vertical conducting plates that are fixed to and that are in electrical connection with the respective one of said members, a plurality of terminal pins that are in electrical connection with said conducting plates, respectively, and a plurality of electric wires that are adapted to connect said terminal pins respectively to the power supply.

5. The conducting roller assembly as claimed in claim 1, wherein each of said conducting units further includes two horizontal rows of equidistant vertical conducting plates that are fixed to and that are in electrical connection with two opposite sides of the respective one of said members, a plurality of terminal pins that are in electrical connection with said conducting plates, respectively, and a plurality of electric wires that are adapted to connect said terminal pins respectively to the power supply.

6. The conducting roller assembly as claimed in claim 1, wherein each of said conducting units further includes two post-connecting bodies, which are formed respectively and integrally with corresponding ones of said rows of said posts and which are fixed to a respective one of said members.

* * * * *